United States Patent [19]

Scheffers et al.

[11] 4,416,376

[45] Nov. 22, 1983

[54] BAG PACKAGE AND RELATED METHOD

[75] Inventors: Richard W. Scheffers, Mount Prospect; Hugo Boeckmann, Arlington Heights, both of Ill.

[73] Assignee: Signode Corporation, Glenview, Ill.

[21] Appl. No.: 431,449

[22] Filed: Sep. 30, 1982

[51] Int. Cl.[3] ..... A45C 11/20; B65D 73/00

[52] U.S. Cl. ..... 206/554; 206/494; 493/413; 493/411; 53/429

[58] Field of Search ..... 206/425, 449, 554, 494; 493/451, 433, 430, 413, 411; 53/429, 143

[56] References Cited

U.S. PATENT DOCUMENTS

| | | | |
|---|---|---|---|
| 3,000,549 | 9/1961 | Stange et al. | 206/554 |
| 3,285,407 | 11/1966 | Abramson | 206/554 |
| 3,699,746 | 10/1972 | Titchenal et al. | 53/384 |
| 3,744,211 | 7/1973 | Titchenal et al. | 53/384 |
| 4,201,029 | 5/1980 | Lerner | 206/494 |
| 4,210,247 | 7/1980 | Frye et al. | 206/494 |

FOREIGN PATENT DOCUMENTS

| | | | |
|---|---|---|---|
| 881349 | 11/1961 | United Kingdom | 206/494 |

*Primary Examiner*—Joseph Man-Fu Moy
*Attorney, Agent, or Firm*—Allen J. Hoover

[57] ABSTRACT

A chain of plastic bags having zipper-locking profiles is packaged in a rectangular carton in successive layers wherein the profiles of the bags of each layer are aligned generally along a straight line that is oblique with respect to a front wall of the carton, the straight lines aligning the profiles of successive layers following a zigzag course, which oscillates between the front wall and a back wall of the carton.

8 Claims, 3 Drawing Figures

BAG PACKAGE AND RELATED METHOD

BACKGROUND OF THE INVENTION

This invention pertains to a method to package a chain of plastic bags having zipper-locking profiles in a rectangular carton and to a package formed in accordance with the method.

As exemplified in U.S. Pat. No. 3,699,746, U.S. Pat. No. 3,744,211, and South African Pat. No. 78/1216, it is known for plastic bags, as formed of plastic film in a rectangular shape having an upper edge, a lower edge, and opposite lateral edges with zipper-locking profiles running along each bag near its upper edge to be connected one after another at a trailing lateral edge of one and a leading lateral edge of another so as to form a chain of such bags. U.S. Pat. No. 3,699,746 mentions in column 9, lines 50 through 54, but does not disclose such profiles. Another possible arrangement of such bags is disclosed in U.S. Pat. No. 3,815,317.

A novel chain of such bags having zipper-locking profiles is described in a patent application entitled "PLASTIC BAG CHAIN," filed simultaneously herewith by Peter Lems, and assigned commonly herewith.

As exemplified in U.S. Pat. Nos. 4,201,029 and 3,699,746, it is known for a chain of plastic bags without zipper-locking profiles to be stacked in a rectangular stack, which is bounded essentially by the top and bottom edges of the bags. U.S. Pat. No. 4,201,029 discloses such a stack in a rectangular carton.

Because zipper-locking profiles are considerably thicker than other portions of such bags, and because such profiles tend to lie upon each other, a rectangular stack of such bags having such profiles tends to be unstable if not confined (as in a rectangular carton) and to require excessive space if confined so as not to be unstable.

There has been a need, to which this invention is addressed, for a better way to package a chain of plastic bags in a rectangular carton, wherein each bag is formed of plastic film in a rectangular shape having an upper edge, a lower edge, and opposite lateral edges with zipper-locking profiles running along such bag near its upper edge, wherein the bags in the chain are connected one after another at a trailing lateral edge of one and a leading lateral edge of another. The upper edge of each bag may correspond to an upper mouth of such bag.

SUMMARY OF THE INVENTION

In accordance with this invention, a chain of plastic bags is packaged in a rectangular carton having a bottom wall and two opposite pairs of vertical walls, wherein each bag is formed of plastic film in a rectangular shape having an upper edge, a lower edge, and opposite lateral edges with zipper-locking profiles running along such bag near its upper edge and wherein the bags in the chain are connected one after another at a trailing lateral edge of one and a leading lateral edge of another.

A whole number of the bags in the chain are laid onto the bottom wall of carton so as to form a first layer of the bags in the chain, and so as to align the profiles of the bags of the first layer generally along a straight line that is oblique with respect to a selected one of the walls of the carton. The vertical chain is folded where two successive bags in the chain are connected to each other.

A whole number of the bags in the chain are laid onto the first layer so as to form a second layer of the bags in the chain, and so as to align the profiles of the bags of the second layer generally along a straight line that is oblique with respect to the selected one of the vertical walls of the carton and with respect to the profiles of the first layer. The chain is folded again where two successive bags in the chain are connected to each other.

A whole number of the bags in the chain are laid onto the second layer so as to form a third layer of the bags, and so as to align the profiles of the bags of the third layer along a straight line that is parallel to but spaced from the straight line aligning the profiles of the first layer. The straight lines aligning the successive layers follow a zigzag course.

Each of the successive layers may have an equal number of the bags. The chain may be folded successively and more successive layers may be laid in like manner so that the bottom wall of the carton is substantially covered by the successive layers thus laid.

Furthermore, the chain may be folded successively and more successive layers may be laid in like manner so that the successive layers substantially covering the bottom wall of the carton are substantially covered in like manner, the zigzag course thus oscillating between the selected one of the vertical walls and the opposite wall of the carton.

Accordingly, a rectangular carton of any suitable size may be densely packed with such bags, which may be withdrawn readily for later use in automatic handling equipment or for manual use.

These and other objects, features, and advantages of this invention will be evident from the following description of a preferred embodiment of this invention.

DESCRIPTION OF THE DRAWINGS

FIG. 2 is taken on an enlarged scale.

FIG. 3 is taken on an enlarged scale. As compared to FIGS. 1 and 2, FIG. 3 shows more layers of the bags.

DETAILED DESCRIPTION OF PREFERRED EMBODIMENT

Figure 1:
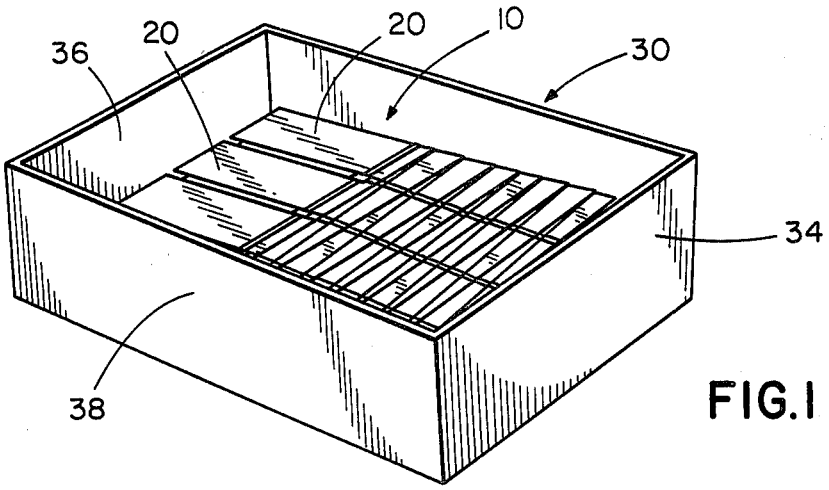
FIG. 1 is a perspective view of a rectangular carton containing a chain of plastic bags packaged in the carton in accordance with this invention.

As shown in the drawings, a chain 10 of plastic bags 20 is packaged in a rectangular carton 30, which may be made of corrugated paperboard or other suitable material, and which has a bottom wall 32 and opposite pairs of vertical walls, namely, a front wall 34, a back wall 36 being opposite to the front wall 34, and opposite side walls 38.

As shown in the drawings, the chain 10 of plastic bags 20 is made in accordance with the patent application entitled "PLASTIC BAG CHAIN," filed simultaneously herewith by Peter Lems, and assigned commonly herewith. Each bag 20 is formed of plastic film in a rectangular shape having an upper edge 22, a lower edge 24, and opposite lateral edges 26, the upper edge 22 corresponding to an upper mouth of such bag 20. Each bag 20 has zipper-locking profiles 28 running along such bag 20 near its upper edge 22. Herein, such terms as "upper," "lower," and "lateral" refer to the bags 20 in a common and preferred orientation, in which the bags 20 may be placed while being filled. In the carton 30, as shown, the bags 20 are not so oriented. The bags 20 in the chain 10 are connected one after another at a trailing lateral edge 26 of one and a leading lateral edge 26 of another. In accordance with the patent application noted above, the bags 20 may be connected to each other solely at the profiles 28.

As shown in the drawings, the first four bags 20*a*, 20*b*, 20*c*, and 20*d* of the bags 20 of the chain 10 have been laid onto the bottom wall 32 of the carton 30 so as to form a first layer of the bags 20 in the chain 10, and so as to align the profiles 28 of the bags 20*a*, 20*b*, and 20*d* of the first layer generally along a straight line, which is oblique with respect to the front wall 34 of the carton 30. The chain 10 is folded, at a point 52 indicated in FIG. 1, where the bag 20*d* and the next bag 20*e* in the chain 10 are connected to each other.

As shown in the drawings, the second four bags 20*e*, 20*f*, 20*g*, and 20*h* of the bags 20 of the chain 10 have been laid onto the first layer so as to form a second layer of the bags 20 in the chain, and so as to align the profiles 28 of the bags 20*e*, 20*f*, 20*g*, and 20*h* of the second layer generally along a straight line, which is oblique with respect to the front wall 32 and with respect to the straight line aligning the profiles 28 of the bags 20*a*, 20*b*, and 20*c*, and 20*d* of the first layer. The chain 10 is folded again, at a point 54 indicated in FIG. 2, where the bag 20*h* and the next bag 20*i* of the chain 10 are connected to each other.

Figure 2:
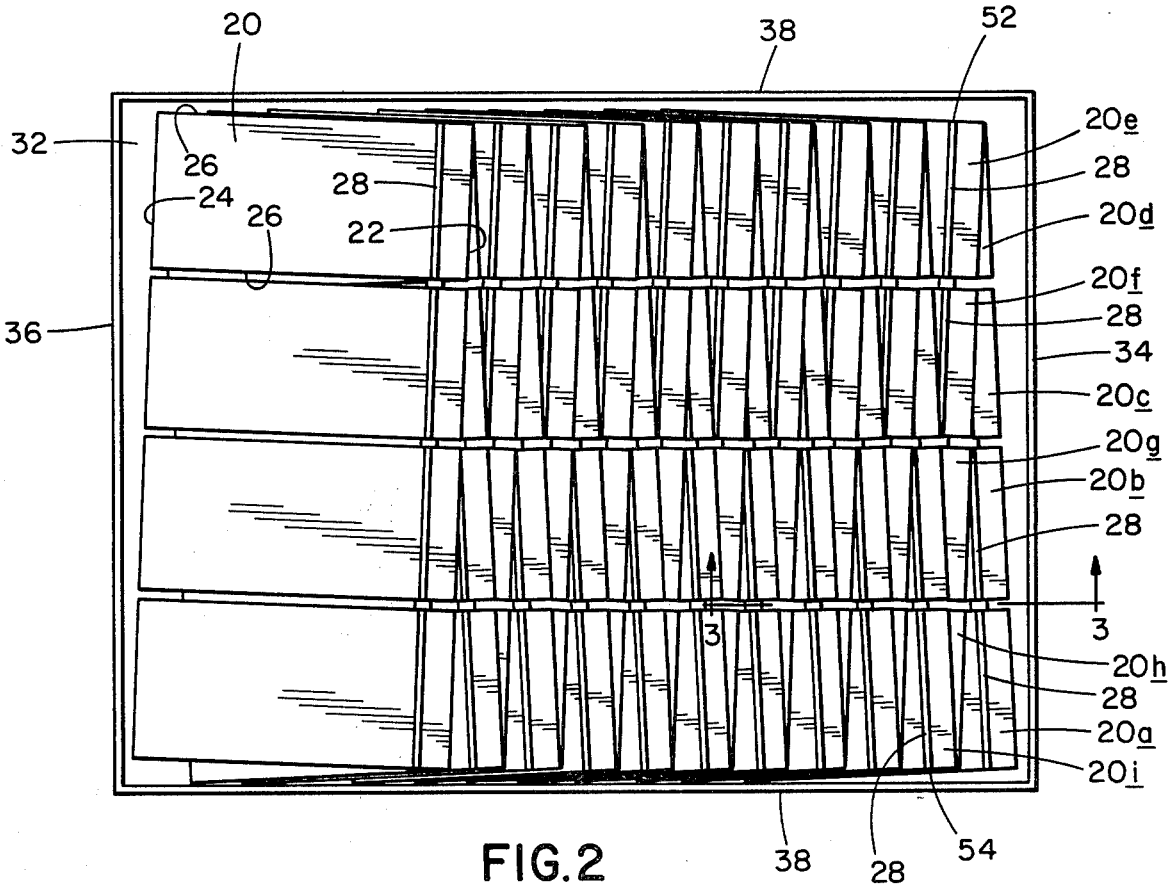
FIG. 2 is a top plan view of what is shown in FIG. 1. As compared to FIG. 1.

As shown in FIGS. 1 and 2 the third four bags 20*i* (and so on) of the bags 20 of the chain 10 have been laid onto the second layer so as to form a third layer of the bags 20 in the chain 10, and so as to align the profiles 28 of the bags 20*i* (and so on) of the third layer generally along a straight line, which is parallel to but spaced from the straight line aligning the profiles 28 of the first layer, and which thus is oblique with respect to the straight line aligning the profiles 28 of the second layers.

As shown in FIGS. 1 and 2, the chain 10 is folded successively and more successive layers may be laid in like manner so that the bottom wall 32 of the carton is substantially covered by the successive layers thus laid. The straight lines aligning the profiles 28 of the successive layers follow a zigzag course.

Figure 3:
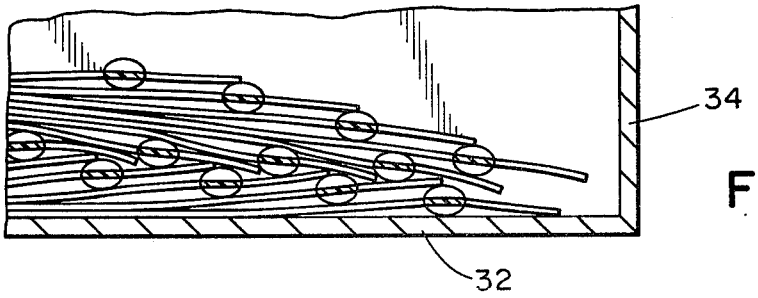
FIG. 3 is a sectional view taken along line 3—3 of FIG. 2 in a direction indicated by arrows. As compared to FIG. 2.

As shown in FIG. 3, wherein more layers of the bags 20 are shown, the chain 10 may be folded successively and more successive layers may be laid in like manner so that the successive layers substantially covering the bottom wall 32 of the carton 30 are substantially covered in like manner. These steps may be repeated until the carton has been substantially filled with the bags 20. The straight lines aligning the profiles of the successive layers continue to follow a zigzag course, which oscillates between the front wall 34 and the back wall 36.

After the carton 30 has been substantially filled with the bags 20, resilient packing material (not shown) may be placed upon the uppermost layers of the bags 20 and a cover (not shown) may be applied to the carton 30, which may be strapped, typed, or tied for shipment or storage. Thus, a dense, stable package may be made.

We claim:

1. A method to package a chain of plastic bags in a rectangular carton having a bottom wall and two opposite pairs of vertical walls, wherein each bag is formed of plastic film in a rectangular shape having an upper edge, a lower edge, and opposite lateral edges with zipper-locking profiles running along such bag near an upper edge of such bag, and wherein the bags in the chain are connected one after another at a trailing lateral edge of one and a leading lateral edge of another, the method comprising steps of (a) laying a whole number of the bags in the chain onto the bottom wall of the carton so as to form a first layer of the bags in the chain, and so as to align the profiles of the bags of the first layer generally along a straight line that is oblique with respect to a selected one of the vertical walls of the carton, (b) folding the chain where two successive bags in the chain are connected to each other, (c) laying a whole number of the bags in the chain onto the first layer so as to form a second layer of the bags in the chain, and so as to align the profiles of the bags of the second layer generally along a straight line that is oblique, (d) laying a whole number of the bags in the chain onto the second layer so as to form a third layer of the bags, and so as to align the profiles of the bags of the third layer generally along a straight line that is parallel to but spaced from the straight line aligning the profiles of the first layer, wherein the straight lines aligning the successive layers follow a zigzag course.

2. The method of claim 1 wherein each of the successive layers has an equal number of the bags.

3. The method of claim 1 or 2 wherein the chain is folded successively and more successive layers are laid in like manner so that the bottom wall of the carton is substantially covered by the successive layers thus laid.

4. The method of claim 3 wherein the chain is folded successively and more successive layers are laid in like manner so that the successive layers subsequently covering the bottom wall of the carton are substantially covered in like manner, the zigzag course thus oscillating between the selected one of the vertical walls and the opposite wall of the carton.

5. A package comprising a rectangular carton having a bottom wall and two opposite pairs of vertical walls and a chain of plastic bags, wherein each bag is formed of plastic film in a rectangular shape having an upper edge, a lower edge, and opposite lateral edges with zipper-locking profiles running along such bag near the upper edge of such bag, wherein the bags in the chain are connected one after another at a trailing lateral edge one and a leading lateral edge of another, wherein a whole number of other bags in the chain are laid onto the bottom wall of the carton so as to form a first layer of the bags in the chain, and so as to align the profiles of the bags of the first layer generally along a straight line that is oblique with respect to a selected one of the vertical walls of the carton, wherein the chain is folded where two successive bags in the chain are connected to each other, wherein a whole number of the bags in the chain are laid onto the first layer so as to form a second layer of the bags in the chain, and so as to align the profiles of the bags of the second layer generally along a straight line that is oblique with respect to the profiles of the first layer, wherein the chain is folded again where two successive bags in the chain are connected to each other, wherein a whole number of the bags in the chain are laid onto the second layer so as to form a third layer of the bags and so as to align the profiles of the bags of the third layer generally along a straight line that is parallel to but spaced from the straight line aligning the profiles of the first layer, and wherein the straight lines aligning the successive layers follow a zigzag course.

6. The package of claim 5 wherein each of the successive layers has an equal number of the bags.

7. The package of claim 5 or 6 wherein the chain is folded successively and more successive layers are laid in like manner so that the bottom wall of the carton is substantially covered by the successive layers thus laid.

8. The package of claim 7 wherein the chain is folded successively and more successive layers are laid in like manner so that the successive layers substantially covering the bottom wall of the carton are substantially covered in like manner, the zigzag course thus oscillating between the selected one of the vertical walls and the opposite wall of the carton.

* * * * *